US005788478A

United States Patent [19]

DeNoia et al.

[11] Patent Number: 5,788,478

[45] Date of Patent: Aug. 4, 1998

[54] RETRACTION MECHANISM FOR A SMOKING MATERIAL LIGHTER

[75] Inventors: Joseph M. DeNoia, Pompano Beach; Michael M. Anthony, Coral Springs, both of Fla.

[73] Assignee: Got-A-Lite!, Pompano Beach, Fla.

[21] Appl. No.: 678,256

[22] Filed: Jul. 11, 1996

[51] Int. Cl.[6] ..... F23Q 2/32

[52] U.S. Cl. ..... 431/253; 242/381

[58] Field of Search ..... 431/253; 24/3.13; 242/381

[56] References Cited

U.S. PATENT DOCUMENTS

| | | | |
|---|---|---|---|
| 823,761 | 6/1906 | Carlton . | |
| 1,443,993 | 2/1923 | Koster . | |
| 1,465,281 | 8/1923 | Morrison . | |
| 1,728,862 | 9/1929 | Horvath . | |
| 1,829,161 | 10/1931 | Smithson et al. . | |
| 2,732,148 | 1/1956 | Lummis . | |
| 2,860,842 | 10/1958 | Ryan . | |
| 2,904,282 | 9/1959 | Zelnick . | |
| 3,907,256 | 9/1975 | Kankkunen | 242/381 |
| 3,968,670 | 7/1976 | Quenot . | |
| 4,486,169 | 12/1984 | Lewis | 431/253 |
| 4,735,377 | 4/1988 | Zuehsow . | |
| 4,898,532 | 2/1990 | Bercik | 431/253 |
| 4,927,354 | 5/1990 | Sanford | 431/253 |
| 4,953,809 | 9/1990 | Barrus . | |
| 5,026,274 | 6/1991 | Jacob | 431/253 |
| 5,246,183 | 9/1993 | Leyden . | |

*Primary Examiner*—Carl D. Price
*Attorney, Agent, or Firm*—Quarles & Brady

[57] ABSTRACT

A retraction mechanism for a lighter includes a case with a pinion rotatably mounted therein. A spool is attached to the pinion and a cord, for attaching to the lighter, is wound onto the spool. A spring is provided to rotate the pinion in a direction which winds the cord onto the spool. A rack has teeth that engage teeth on the pinion so that the rack moves linearly with rotation of the pinion. A cylinder body with an aperture is located within the case and a piston, attached to the rack, is within the aperture thereby defining a cylinder chamber which varies in size as the piston moves within the aperture. A passage in the piston allows air to flow between the cylinder chamber and the interior of the case as the cylinder chamber varies in size. The passage has an orifice which changes in size with movement of the piston within the cylinder body, thereby providing a device which dampens winding and unwinding of the cord about the spool.

18 Claims, 2 Drawing Sheets

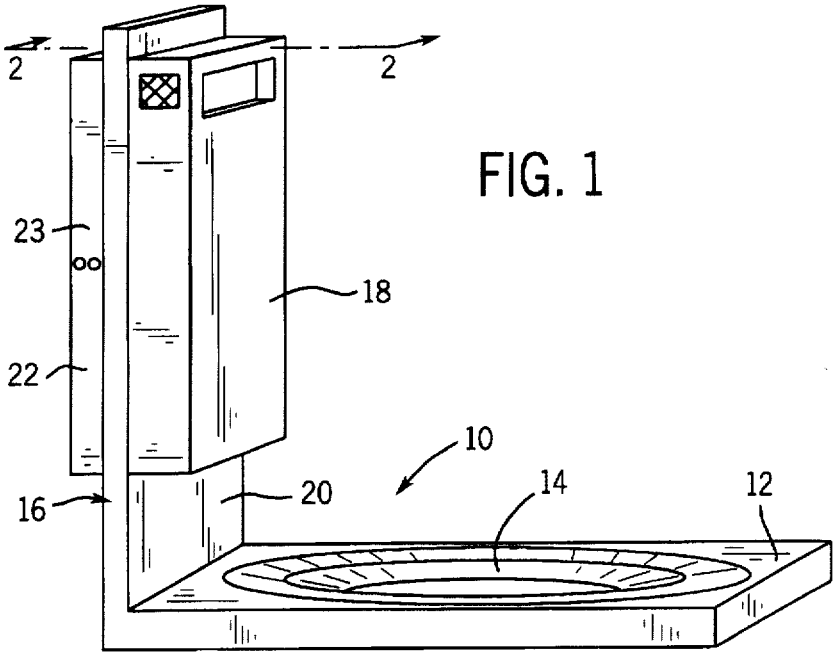
FIG. 1
FIG. 2
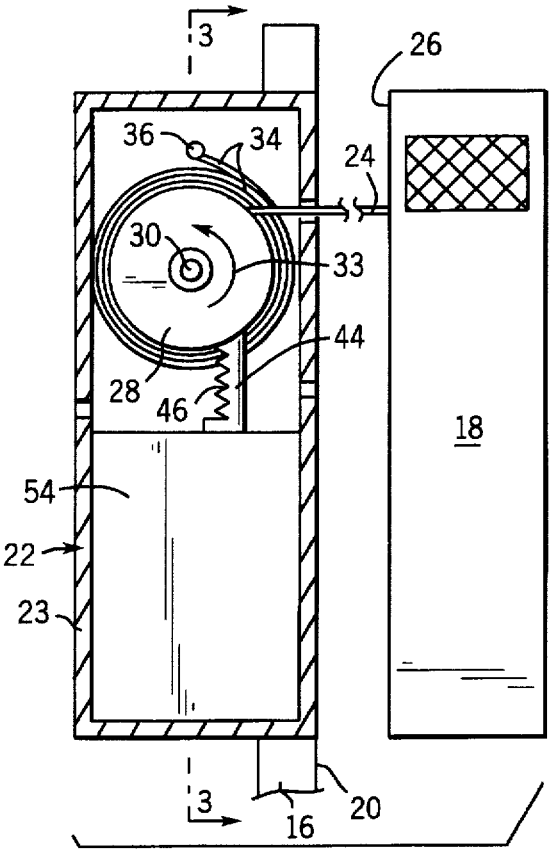
FIG. 3
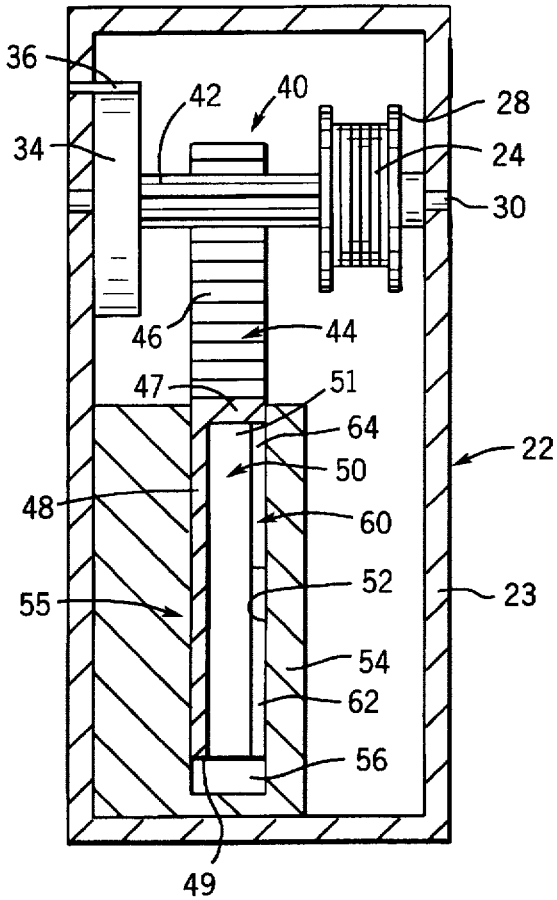

RETRACTION MECHANISM FOR A SMOKING MATERIAL LIGHTER

BACKGROUND OF THE INVENTION

The present invention relates to devices for igniting smoking materials, such as cigarettes; and more particularly to mechanisms for retracting such igniting devices to a storage location.

Cigars, cigarettes and pipes are commonly ignited for smoking by means of a lighter which includes a source of fuel, such as butane, and a device for creating a spark to ignite the fuel. This action produces a flame which allows the user to ignite the smoking material. Such lighters are relatively small being able to fit within a pocket or purse of a user. However, the small size has a disadvantage in that the lighter can easily be misplaced after use. For example, the user may leave it on a desk or table rather than returning it to the pocket or purse. In addition, lighters are often provided adjacent ashtrays as a convenience for smokers. However, smokers may inadvertently remove the lighters from these locations.

SUMMARY OF THE INVENTION

A general object of the present invention is to provide a mechanism which prevents removal of a lighter for smoking material and automatically retracts the lighter to a storage location.

Another object is to provide such a retraction mechanism which operates in a controlled manner that will not cause injury to a user or damage to the lighter.

A further object of the present invention is to provide a smoking material lighter retraction mechanism which can be adapted for a number of uses, for example for use in combination with an ashtray or for carrying by a person.

These objects are fulfilled by a retraction mechanism in which a cord, adapted to be fastened to the lighter, is wound onto a spool. A spring produces rotation of the spool which winds the cord onto the spool. A pinion with teeth is coupled to the spool so that rotation of the spool produces rotation of the pinion. A rack has teeth that engage the teeth of the pinion so that the rack moves linearly with rotation of the pinion.

A damper includes a piston attached to the rack. The piston is movably received in an aperture of a cylinder body, thereby defining a cylinder chamber which varies in size as the piston moves within the aperture. The damper has a passage through which air flows between the cylinder chamber and an exterior environment of the cylinder body as the cylinder chamber varies in size. This passage has a an orifice which changes in size with movement of the piston within the cylinder body. As the orifice changes in size the impedance to air flow through the passage also changes which varies the resistance to the movement of the piston within the cylinder body aperture. This resistance is transferred mechanically to the spool thereby restricting the winding and unwinding of the cord about the spool. Preferably, the change in the size of the orifice is configured so that resistance to movement increases the farther the cord extends from the spool.

In the preferred embodiment of the retraction mechanism, the passage is formed as a groove in the outer surface of the piston.

The width of the groove varies along its length wherein the amount of the groove that is exposed from the cylinder body changes as the piston moves in the aperture. In this embodiment the orifice is formed at the opening of the groove in the piston surface and the opening size varies with piston movement.

Other features of the retraction mechanism are described hereinafter.

BRIEF DESCRIPTION OF THE DRAWINGS

FIG. 1 is an isometric view of an ashtray with a lighter attached to a novel retraction mechanism according to the present invention;

FIG. 2 is a cross-sectional view taken along LINE 2—2 in FIG. 1; and

FIG. 3 is a cross-sectional view taken along LINE 3—3 in FIG. 2;

DETAILED DESCRIPTION OF THE INVENTION

Figure 4:
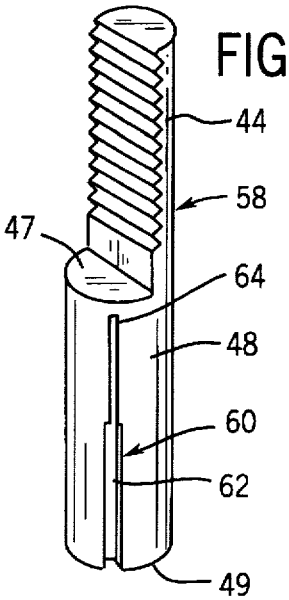
FIG. 4 is an isometric view of the piston in FIG. 2.

With initial reference to FIG. 1, an ashtray 10 has a horizontal member 12 with a bowl 14 formed therein for receiving ashes and discarded smoking material. The ashtray 10 has a vertical member 16 to which is attached a conventional lighter 18 for igniting smoking materials such as cigarettes, cigars and pipes. Although the lighter 18 is illustrated as a rectilinear object, the present invention can be utilized with a wide variety of lighters utilizing various fuels and having different geometric shapes. When not in use, the lighter 18 is held against one side 20 of the vertical member 16 which faces the bowl 14. As will be described in detail, a retraction mechanism 22, which is attached to the opposite side of the vertical member 16, holds the lighter in this position. The present retraction mechanism also can be attached to other types of ashtrays.

With reference to FIGS. 2 and 3, the retraction mechanism 22 has a cord 24 with one end attached to the rear surface 26 of the lighter 18. The cord may be permanently attached to the lighter to prevent theft or removably attached to enable replacement of the lighter upon consumption of the fuel. The cord 24 may be a string, wire or a ribbon as shown in the Figures and can be fabricated from a variety of materials such as a fiber based plastic cord or a plastic coated metal wire typically found on retractable key chains. As used herein, the term "cord" includes all of these variations of element 24 and others which are apparent to one skilled in this art. The cord can be extended from the case 23 of the retraction mechanism 22 as shown in FIG. 2 thereby allowing the lighter 18 to be brought toward the user.

The other end of the cord 24 is attached to and wound onto a spool 28 within the retraction mechanism 22. The spool 28 is coupled to a shaft 30 extending between opposing sidewalls of the case 23 and allowed to rotate therein. A coil spring 34 has an inner end fixedly attached to the shaft 32 and an outer end fastened by a pin 36 to the inside of the retraction case 23. The coil spring 32 biases the shaft in a rotational direction indicated by arrow 33 which causes the cord 24 to wind onto the spool 28.

The retraction mechanism 22 also includes a pinion 42 fixedly attached to the shaft 32 so as to rotate together. A rack 44 has a plurality of gear teeth 46 which engage the teeth of the pinion 42 thus causing the rack 44 to be raised and lowered linearly within the case 23 as the pinion rotates with shaft 32. The pinion 44 is integral with a piston 48 located snugly within a cylindrical aperture 52 of a cylinder body 54 that is coupled to the retractor case 23. Thus, as the rack 44 is lowered and raised by the rotation of the pinion 42, the piston 48 similarly moves linearly in to and out of the cylinder aperture 52 thereby varying the size of a cylinder chamber 56.

The piston 48 has a cylindrical shape with a passage 50 providing a path for air to travel through the piston, as will be described. The passage 50 is formed by a central bore 51 extending inward from the interior end 49 of the piston that forms a wall of cylinder chamber 58 to almost the other end joined to the rack 44, thus leaving a closed end section 47 of the piston 48. With additional reference to FIG. 4, a groove 60 extends longitudinally along the piston and outward from the central bore 51 to the exterior surface. This groove 60 has a relatively wide portion 62 adjacent interior end 49 of the piston, and a narrower portion 64 along the remainder of the groove's length. The two groove portions 62 and 64 provide different sized openings or orifices through which air flows to and from the central bore 51.

As shown in FIG. 1, lighter 18 normally is held against the vertical member 16 of the ashtray 10 by the retraction mechanism 22. When a smoker desires to ignite smoking material, the user grasps the lighter 18 and pulls it away from the vertical member 16 toward the smoking material. As this occurs, cord 24 is pulled out of the retraction mechanism 22 unwinding the cord from the spool 28. The resultant rotational movement of the spool 28 is transferred via shaft 32 to the pinion 42 which winds the coiled spring 32 storing energy therein. As the pinion 42 rotates, the rack 44 is pushed linearly downward causing the attached cylinder 42 to move farther into the cylinder aperture 52. This action compresses air within the cylinder chamber 56 forcing the pressurized air through passage 50 in the piston 48 formed by central bore 51 and groove 60. When the lighter 18 is against the ashtray 10, a substantial section of the piston 48 projects out of the cylinder aperture 52 and a significant amount of the groove 60 is exposed inside the case 23, thereby providing a relatively large orifice through which flows the air escaping the cylinder. As the piston moves farther into the aperture the air flow passage orifice provided by the groove 60 decreases which increases the resistance to further movement of the piston. That resistance is transferred to the cord 24 slowing the movement of the lighter 18.

Continued extraction of the cord 24 from the retraction mechanism 22 eventually pushes the piston 48 into the cylinder aperture 52 to the point where the closed end section 47 of the piston enters the cylinder which closes the passage 50 cutting off the flow of air out of the cylinder chamber 56. When this happens, the air trapped within the cylinder chamber 56 cannot escape and merely is compressed. This stops the piston 48 from moving farther into the cylinder aperture 52 and prevents further rotation of shaft 32 and extraction of the cord 24 from the retraction mechanism 22.

After the smoker ignites the smoking material, the lighter 18 is released from the user's hand or placed adjacent to the ashtray 10. Energy stored in the coil spring 34, during the extraction of the cord 24 from the retractor case 23, causes the shaft 32 to rotate in a direction 33 which winds the cord 24 onto the spool 28. The force of the spring 34 if left undamped could result in the cord 24 being retracted rapidly into the case 23 causing in the lighter 18 to snap against the surface 20 of the ashtray 10. To prevent this from occurring, the piston and cylinder act as a damper 55 to the spool motion produced by the coil spring 34. As the coil spring 34 is unwinding, the pinion 42 by its engagement with the rack 44 raises the piston 48 within the cylinder aperture 52. This action increases the size of the piston cavity 56 producing a partial vacuum which inhibits the upward movement of the piston. In order for piston 48 to move farther upward, air must flow through the passageway 50 and into the piston chamber 56. The case 23 has holes 25 through which air enters and leaves the case. Because only a small orifice into the passage is initially provided by groove portion 64, the air flow is limited providing resistance to rapid upward movement of the piston-rack assembly. This resistance is transferred to the shaft 30 restricting the speed at which the cord 24 is retracted into the case 23 and onto the spool 28. Thus, the damping action provided by the piston and cylinder result in the cord being retracted onto the spool at a reasonable rate preventing injury to the smoker and damage to the lighter 18.

As the piston 48 moves out of the cylinder aperture 52, more of the groove 60 is exposed inside the case 23 thereby increasing the opening to the air passage 60 through the piston and decreasing the movement resistance. This causes the speed of core retraction to increase. The shape the groove 50 can be contoured to provide different movement resistance characteristics. Eventually, the cord 24 will be retracted onto the spool to the point where lighter 18 is held against surface 20 of the ashtray 10, as shown in FIG. 1.

Figure 5:
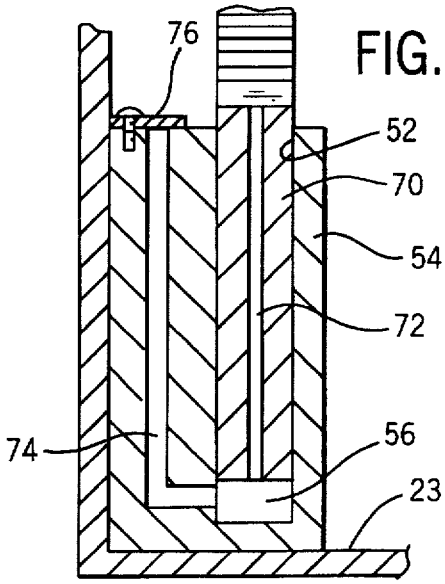
FIG. 5 is a partially broken-away view of an alternative version of a piston and cylinder dampening mechanism.

FIG. 5 shows an alternative embodiment for the damping mechanism provided by piston 48 and cylinder 54. In this version the piston 70 has a passage 72 extending therethrough between the inner and outer ends, although piston 48 also may be used. In addition, a secondary passage 74 is created through the cylinder body 54. The secondary passage 74 extends from the innermost end of the cylinder aperture 52 to a surface of the body 54. A one-way valve 76 closes the orifice of passage 74 at the surface of body 54 and allows air to flow only from the cylinder chamber 56.

For example, the valve 76 may comprise a sheet of resilient material, such as rubber, loosely held over the outer opening of the secondary passage 74.

In this embodiment, the secondary passage 74 enables air to more rapidly escape the cylinder chamber 56 as the piston 48 moves into the cylinder aperture 52. The pressure of the air within the cylinder chamber 56 and secondary passage 74 pushes the valve open allowing the air to escape. However, when the piston 48 begins to move out of the cylinder aperture 52, the valve 76 closes preventing air from entering the expanding cylinder chamber 56 through the secondary passage 74. This one-way valve 76 provides lower damping resistance to the extraction of the cord 24 from the retraction mechanism 22 as compared to the damping force during the retraction of the cord onto spool 28. Thus, the user can pull the lighter 18 from the retraction mechanism with relative ease, but the increased dampening force during retraction inhibits the lighter from being pulled too rapidly into the retractor case 23.

Figure 6:
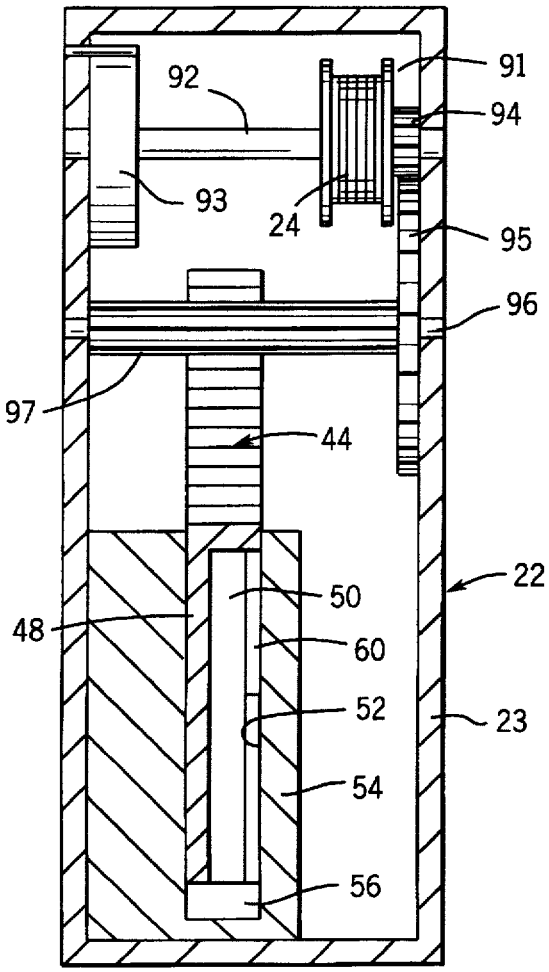
FIG. 6 is a cross-sectional view of an alternative embodiment of the present invention.

Another novel retraction mechanism 90 is illustrated in FIG. 6 which enables a greater length of cord to be pulled from the case 23. The cord 24 is wound around a spool 91 fixedly mounted on a shaft 92 to which a coil spring 93 connects. The cord now comes off the underside of the spool 91 and the coil spring 93 is wound to store energy by rotation in the opposite direction to that described with respect to FIGS. 2 and 3. The new embodiment has a first gear 94 attached to the spool shaft 92. The first gear 94 meshes with a larger second gear 95 attached to another shaft 96 on which pinion 97 also is mounted. A rack 44, that is integral with a damping piston 48, has teeth which engage the teeth of the pinion 97. The components of cylinder body 54 are the same as in the embodiment of FIGS. 2 and 3.

The ratio of the first and second gears 94 and 95 is such that the first gear 94 makes several revolutions for each revolution of the second gear. Therefore, a longer length of cord 24 has to be pulled from the spool to move the piston 48 the same distance as compared to the embodiment in FIG. 2 and 3. As a consequence the embodiment in FIG. 6 permits the lighter 18 to be pulled farther from the ashtray 10 for use.

Figure 7:
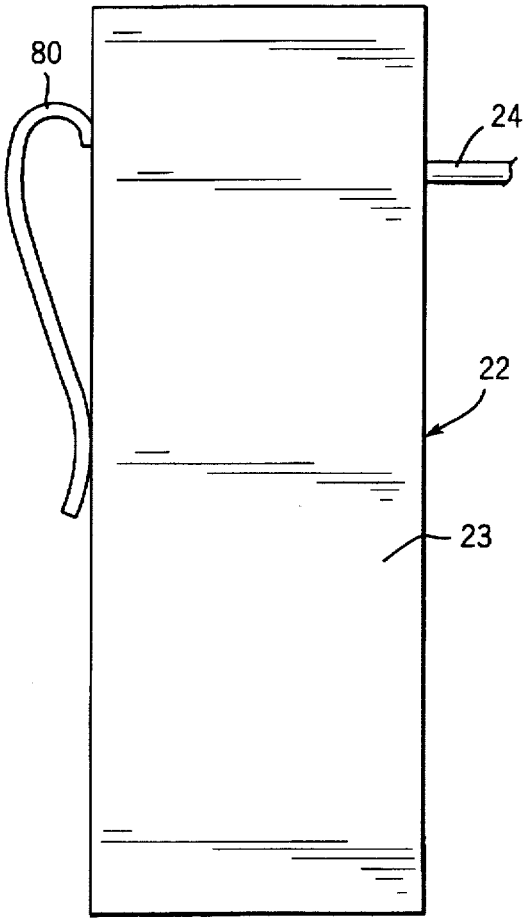
FIG. 7 illustrates a version of the present invention for mounting on a belt of the user.

FIG. 7 illustrates a version of the retraction mechanism 22 in which the case 23 has a belt clip 80 attached thereto. In this version, the retraction mechanism is not attached to an ashtray as shown in FIG. 1, rather the retraction mechanism and lighter 18 can be attached to the smoker's belt via clip 80. Because the lighter is now secured to the user's belt, it is unlikely to be left on a table or elsewhere.

Double-sided adhesive tape may be applied to the outer surface of the retractor case 23 in place of belt clip 80, enabling the retraction mechanism 22 to be attached to other objects, such as a standard ashtray, a telephone or a wall. The retraction mechanism 22 can be attached to a wall above a height that is reached easily by small children, so that the lighter will retract automatically after use to a position out of the child's reach.

The foregoing description is directed primarily to preferred embodiments of the invention. Although some attention was given to various alternatives within the scope of the invention, it is anticipated that skilled artisans will likely realize additional alternatives that are now apparent from the disclosure of those embodiments. Accordingly, the scope of the invention should be determined from the following claims and not limited by the above disclosure.

We claim:

1. A retraction mechanism for a lighter wherein the retraction mechanism comprises:

a spool;

a cord wound onto the spool and adapted to be fastened to the lighter;

a spring coupled to the spool to produce rotation of the spool which winds the cord onto the spool;

a pinion with teeth is coupled to the spool wherein rotation of the spool produces rotation of the pinion;

a rack with teeth that engage the teeth of the pinion; and a damper having a piston attached to the rack, and a cylinder body with an aperture within which the piston is movably received thereby defining a cylinder chamber which varies in size as the piston moves within the aperture, the damper having a passage through which air flows between the cylinder chamber and an exterior environment of the cylinder body as the cylinder chamber varies in size.

2. The retraction mechanism as recited in claim 1 wherein the passage of the damper further comprises an orifice which changes in size with movement of the piston within the cylinder body.

3. The retraction mechanism as recited in claim 1 wherein the passage is formed in the piston.

4. The retraction mechanism as recited in claim 1 wherein the piston has an exterior surface and the passage is formed by a groove in the exterior surface.

5. The retraction mechanism as recited in claim 4 wherein the piston has bore which is in communication with the cylinder chamber; and the groove extends between the bore and the exterior surface.

6. The retraction mechanism as recited in claim 4 wherein the groove has a length and has a width that varies along the length of the groove.

7. The retraction mechanism as recited in claim 1 wherein the spool and pinion rotate about a common axis.

8. The retraction mechanism as recited in claim 1 further comprising a first gear connected to the spool, and a second gear meshing with the first gear and connected to the pinion.

9. The retraction mechanism as recited in claim 1 wherein the pinion and piston are formed as a single piece.

10. The retraction mechanism as recited in claim 1 further comprising a secondary passage formed in the cylinder body through which air flows between the cylinder chamber and the exterior environment of the cylinder body; and a valve which allows air to flow through the secondary passage from the cylinder chamber and inhibits air flow through the secondary passage into the cylinder chamber.

11. The retraction mechanism as recited in claim 1 further comprising a case enclosing the spring, pinion, rack and damper; and having a device for attaching the case to a person.

12. A retraction mechanism for a lighter, said retraction mechanism comprising:

a case;

a spool rotatably mounted in the case;

a cord wound onto the spool and having an end adapted to be fastened to the lighter;

a spring coupled to the spool and the case for rotating the spool in a direction which winds the cord onto the spool;

a pinion with teeth is coupled to the spool wherein rotation of the spool produces rotation of the pinion;

a rack has teeth that engage the teeth of the pinion;

a cylinder body within the case and having an aperture;

a piston attached to the rack and located in the aperture of the cylinder body thereby defining a cylinder chamber which varies in size as the piston moves within the aperture, the piston including a passage through which air flows between the cylinder chamber and an exterior environment of the cylinder body as the cylinder chamber varies in size, the passage having an orifice which changes in size with movement of the piston within the cylinder body.

13. The retraction mechanism as recited in claim 12 wherein the piston has an exterior surface and the passage is formed by a groove in the exterior surface.

14. The retraction mechanism as recited in claim 13 wherein the groove has a length and has a width that varies along the length of the groove.

15. The retraction mechanism as recited in claim 12 wherein the spool and pinion rotate about a common axis.

16. The retraction mechanism as recited in claim 12 further comprising a first gear connected to the spool, and a second gear meshing with the first gear and connected to the pinion.

17. A retraction mechanism for a lighter, said retraction mechanism comprising:

a case;

a spool mounted in the case for rotation about an axis;

a cord wound onto the spool and having an end adapted to be fastened to the lighter;

a pinion has teeth and is coupled to the spool wherein rotation of the spool produces rotation of the pinion about the axis;

a spring coupled to the pinion for rotating the pinion in a direction which winds the cord onto the spool;

a rack has teeth that engage the teeth of the pinion so that the rack moves linearly with rotation of the pinion;

a cylinder body coupled to the case and having an aperture;

a piston attached to the rack and located in the aperture of the cylinder body thereby defining a cylinder chamber which varies in size as the piston moves within the aperture, the piston including a passage through which air flows between the cylinder chamber and an exterior environment of the cylinder body as the cylinder chamber varies in size, the passage having an orifice which changes in size with movement of the piston within the cylinder body.

18. The retraction mechanism as recited in claim 17 wherein the piston has an exterior surface and the passage is formed by a groove in the exterior surface, wherein the groove has a length and has a width that varies along the length of the groove.

* * * * *